United States Patent [19]

Ikuta

[11] 4,341,523

[45] Jul. 27, 1982

[54] APPARATUS FOR MANUFACTURING PAPER PIPES

[76] Inventor: Shickinosuke Ikuta, 13, 2-chome, Shimoshinjo-cho, Higashiyodogawa-ku, Osaka-shi, Osaka-fu, Japan

[21] Appl. No.: 173,495

[22] Filed: Jul. 29, 1980

[30] Foreign Application Priority Data

Sep. 17, 1979 [JP] Japan ..... 54-121270

[51] Int. Cl.[3] ..... B31C 3/00

[52] U.S. Cl. ..... 493/301; 162/284; 493/299

[58] Field of Search ..... 162/284; 493/299, 301; 156/195, 428

[56] References Cited

U.S. PATENT DOCUMENTS

| | | | |
|---|---|---|---|
| 3,460,445 | 8/1969 | Ried | 493/301 |
| 3,793,929 | 2/1974 | Snyderman | 493/301 |
| 3,935,801 | 2/1976 | Okazaki | 493/301 |

FOREIGN PATENT DOCUMENTS

| | | | |
|---|---|---|---|
| 569040 | 1/1959 | Canada | 162/284 |

*Primary Examiner*—Steve Alvo

*Attorney, Agent, or Firm*—Wenderoth, Lind & Ponack

[57] ABSTRACT

An apparatus for manufacturing paper pipes including two stationary drums provided on one side of a fixed mandrel and two movable drums provided on the other side of the fixed mandrel. All the four drums are adapted to transmit the driving power of a motor to belts.

1 Claim, 6 Drawing Figures

APPARATUS FOR MANUFACTURING PAPER PIPES

BACKGROUND OF THE INVENTION

The present invention relates to an apparatus for manufacturing paper pipes, and more particularly to an apparatus for manufacturing paper pipes in which a paper tape or tapes are wrapped spirally around a mandrel by means of two belts in such a manner that one longitudinal edge of the paper tape overlaps the other longitudinal edge.

The optimum angles at which the paper tape or tapes should be wrapped spirally around the mandrel differ with the breadth of the paper tape, the diameter of the paper pipe to be manufactured, and the purpose for which the paper pipe is going to be used. For this reason, it is desirable in an apparatus of this kind that the angles formed by the two belts with the mandrel can be adjusted in accordance with the angle at which the paper tape or tapes are going to be wrapped spirally around the mandrel.

Conventional apparatuses of this kind can be divided broadly into two types. One type of the conventional apparatuses includes a single driven drum provided on one side of a mandrel, two driving drums provided on the other side of the mandrel, and two belts which are adapted to operate over the driving and driven drums in a V-shaped arrangement with the driven drum as the vertex. The other type of the conventional apparatuses includes two driving drums provided on one side of a mandrel, two driven drums provided on the other side of the mandrel, and two belts which are adapted to operate over the driving and driven drums in substantially parallel arrangement. In both types of conventional apparatuses, the tight side of each belt winds round the mandrel so that the belt will form a single loop around the mandrel.

In the first type of the conventional apparatuses, the angle formed by the two belts is only slightly adjustable and, consequently, the angle at which the paper tape or tapes are wrapped spirally around the mandrel can be changed only within narrow limits. This drawback makes the first type of the conventional apparatuses unfit for the manufacture of paper pipes other than specific ones.

Another drawback of the first type of the conventional apparatuses is that, because of its intricate and weak structure, the paper tape or tapes cannot be tightly wound round the mandrel. In this connection, it should be borne in mind that the belt tension has a great influence on the strength of paper pipes. In order to obtain a strong paper pipe, it is necessary to strain the belts as much as possible.

In the second type of the conventional apparatuses, too, the angle formed by the two belts is only slightly adjustable. In addition, because a large space is left between the loops formed by the two belts around the mandrel, the mandrel is apt to undergo deflection and the paper tape or tapes cannot be tightly wound around the mandrel in this type of the conventional apparatuses either.

Still another drawback which is common to both types of the conventional apparatuses is that the belts are apt to slip on the driving drums, because not all the drums are adapted to transmit the driving power of the motor to the belts.

SUMMARY OF THE INVENTION

It is an object of the present invention to provide an apparatus having a simple structure which obviates the above-described drawbacks and causes a paper tape or tapes to be tightly wound round the mandrel.

It is an object of the present invention to provide an apparatus in which all the four drums are adapted to transmit the driving power of the motor to the belts so as not to allow the belts to slip on the drums.

It is another object of the present invention to provide an apparatus wherein the combination of two drums, over which each belt is to operate, can be changed so that the angle formed by the two belts is adjustable over a wide range and thereby it is possible to leave a small space between the loops formed by the two belts around the mandrel. Adjustability of the angle formed by the two belts makes the apparatus suitable for the manufacture of various paper pipes. The small space between the loops prevents the mandrel from undergoing deflection, permits the paper tape or tapes to be tightly wound around the mandrel, and makes the apparatus suitable for the manufacture of strong paper pipes.

It is still another object of the present invention to provide an apparatus in which two drums provided on one side of the mandrel are stationary while the remaining two drums provided on the other side of the mandrel can be moved toward or away from the mandrel so as to permit fine adjustment of the angle formed by the two belts.

It is yet still another object of the present invention to provide an apparatus wherein a table, on which the drums are mounted, is movable in the axial direction of the mandrel so that a wide range of choice may be afforded to the position in which a paper tape or tapes are to be fed to the surface of the mandrel.

With these objects in view and as will become apparent from the following detailed description, the present invention will be more clearly understood in connection with the accompanying drawings, in which:

DETAILED DESCRIPTION OF THE INVENTION

Figure 1:
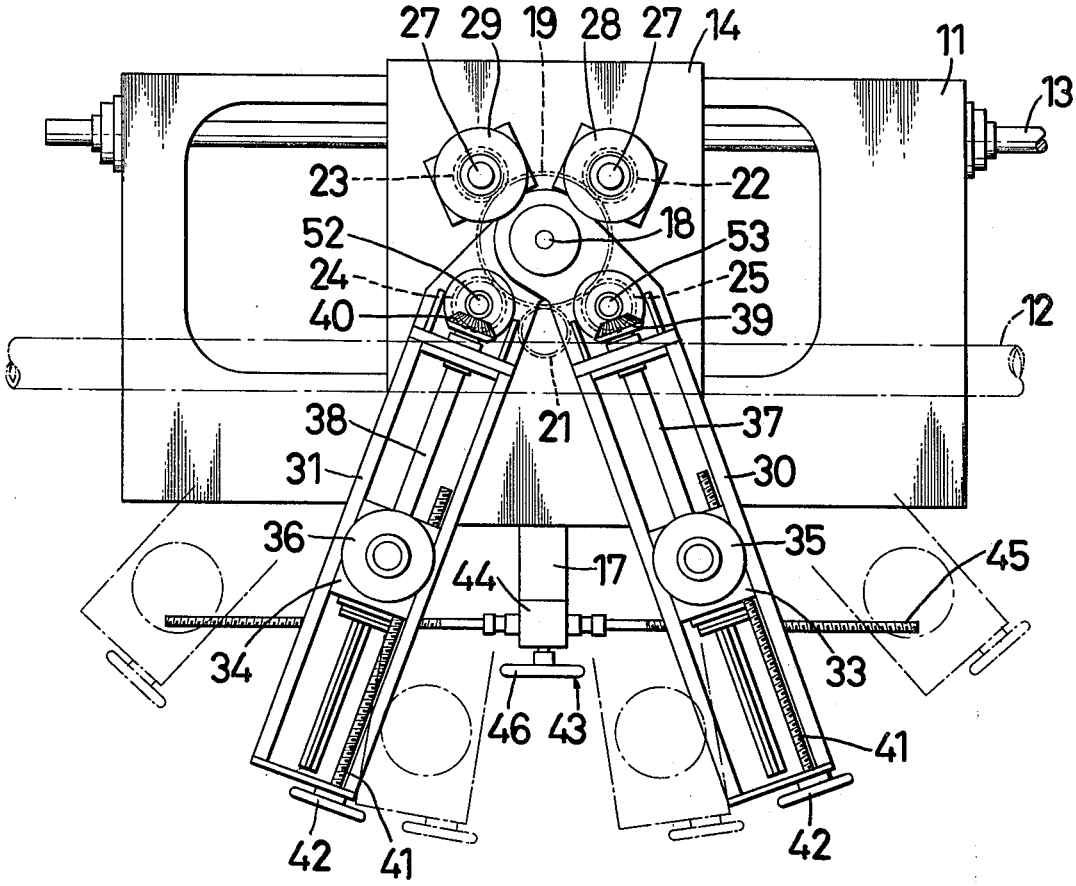
FIG. 1 is a plan view of an apparatus according to the present invention.
Figure 2:
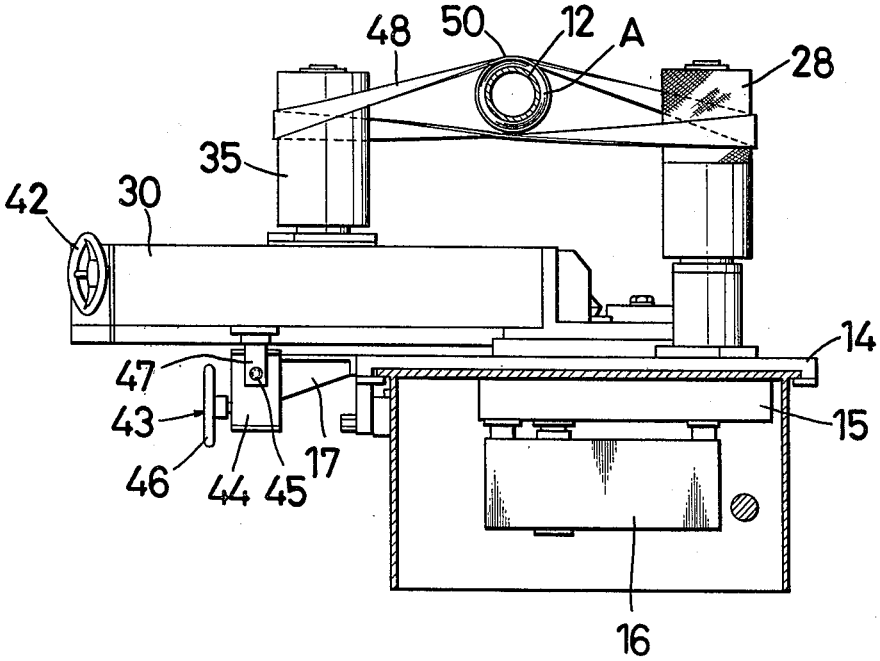
FIG. 2 is a right-hand side elevation view in section thereof.
Figure 3:
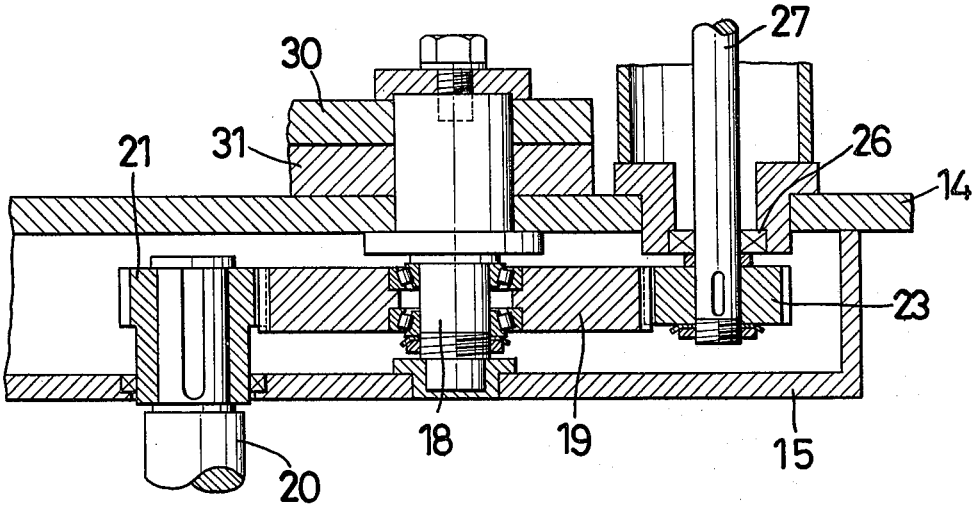
FIG. 3 is an enlarged vertical section of a part thereof, illustrating the arrangement of a central gear through which the driving power of the motor is transmitted to the drums.

Referring now to FIGS. 1 to 3, there is shown an embodiment of an apparatus in accordance with the present invention which includes a fixed mandrel 12, a table 11 provided under the fixed mandrel 12 and adapted to move in the axial direction of the fixed mandrel 12 along a guide bar 13, a horizontal plate 14 fixed in the central part of the table 11, a gear case 15 fixed to the under surface of the horizontal plate 14, and an adjustable speed motor 16 provided under the gear case 15.

The gear case 15 accommodates a large spur wheel 19, which is adapted to rotate on a main vertical shaft 18. The upper end portion of the main shaft 18 projects above the horizontal plate 14. The large spur wheel 19 engages with a driving gear 21 which is mounted on the output shaft 20 of the motor 16. The large spur wheel 19 engages also with four small spur wheels 22, 23, 24 and 25. The line which links the centers of the small spur wheels 22 and 23 runs parallel to the axis of the mandrel 12, and the line which links the centers of the small spur wheels 24 and 25 also runs parallel to the axis of the mandrel 12. The small spur wheels 22 and 23 are fixed to the lower ends of vertical countershafts 27 which are adapted to revolve in bearings 26 mounted on the horizontal plate 14. The upper halves of the countershafts 27 project above the horizontal plate 14, and drums 28 and 29 are fixed to the projecting parts of the countershafts 27 in a stationary position on the table, these drums hereinafter being called stationary drums.

The gear case 15 may be filled with lubricating oil.

Two supporting frames 30 and 31 are provided horizontally over the horizontal plate 14. One end of each of these supporting frames 30 and 31 is supported by the projecting part of the main shaft 18 in such a manner that the two supporting frames 30 and 31 are disposed in a V-shaped arrangement with the main shaft 18 as the vertex, and each supporting frame is allowed to turn freely on the projecting part of the main shaft 18.

It is essential to the apparatus in accordance with the present invention that the countershafts 27 be on one side of the fixed mandrel 12 while the greater part of the two supporting frames 30 and 31 are on the other side of the fixed mandrel 12.

The small spur wheels 24 and 25 are fixed to the lower ends of countershafts 52 and 53. The upper ends of the countershafts 52 and 53 are provided with bevel gears.

Horizontal shafts 37 and 38 are provided in the supporting frames 30 and 31, respectively, extending in the longitudinal directions thereof. The ends of the horizontal shafts 37 and 38 facing the main shaft 18 are provided with bevel gears 39 and 40, respectively, which engage with the bevel gears provided on the upper ends of the countershafts 53 and 52, respectively.

Sliders 33 and 34 are mounted on, and adapted to slide in the longitudinal directions of, the supporting frames 30 and 31, respectively. Drums 35 and 36 are rotatably mounted on the sliders 33 and 34, respectively. The axes of rotation of the drums 35 and 36 run parallel to the axes of rotation of the stationary drums 28 and 29.

The sliders 33 and 34 are provided with holes, which run parallel to the axes of the horizontal shafts 37 and 38, respectively, and are provided with female threads on their inner surfaces. Shafts 41 provided with male threads fit in these holes. The ends of the shafts 41 project out of the free ends of the supporting frames 30 and 31 and are provided with handwheels 42. By turning the handwheels 42, the sliders 33 and 34 can be shifted in the longitudinal directions of the supporting frames 30 and 31, respectively. No matter where the sliders 33 and 34 may be positioned on the supporting frames 30 and 31, the rotatory power of the horizontal shafts 37 and 38 is transmitted to the drums 35 and 36 by some suitable means so as to rotate the drums 35 and 36 in the reverse direction as compared with the direction of rotation of the stationary drums 28 and 29.

A means for adjusting the angle formed by the supporting frames 30 and 31, which is generally designated by the numeral 43, is mounted on the side plate of the table 11. The means 43 includes a bracket 17 fixed to the side plate of the table 11, a gear case 44 supported by the bracket 17, and a plummer block 47 fixed to the under surface of each supporting frame in such a manner that a shaft 45, which extends through the gear case 44 and the plummer blocks 47, is caused to run parallel with the axis of the mandrel 12. One half of the shaft 45 is provided with a right-hand screw thread, while the other half of the shaft 45 is provided with a left-hand screw thread. Each plummer block 47 is provided with a mating female thread. A handwheel 46 for imparting a rotary motion to the shaft 45 is mounted on the gear case 44. By turning the handwheel 46, the angle formed by the supporting frames 30 and 31 can be adjusted.

Figure 4:
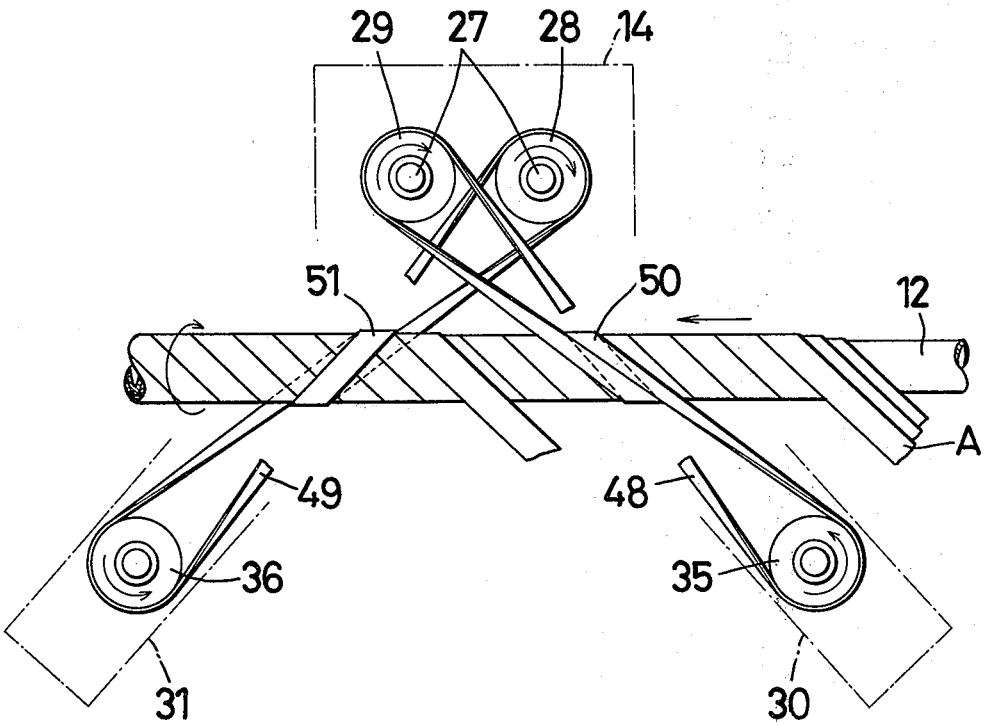
FIG. 4 is a plan view, illustrating a method of stretching each belt between two drums.

Referring now to FIG. 4, a belt 48 is adapted to operate over the drums 29 and 35, and a belt 49 is adapted to operate over the drums 28 and 36. The side of the belt 48 or 49 advancing toward the stationary drum 29 or 28 and the side of the belt 48 or 49 receding from the stationary drum 29 or 28 are crossed in such a manner that the advancing side is placed above the receding side and the mandrel 12 is held between the advancing and receding sides. The upper side of the belt 48, i.e., the side of the belt 48 advancing toward the stationary drum 29, winds round the paper tape or tapes A wrapped around the mandrel 12 in such a manner that the upper side of the belt 48 forms a single loop 50 around the paper tape or tapes A. The lower side of the belt 49, i.e., the side of the belt 49 receding from the stationary drum 28, winds round the paper tape or tapes A wrapped around the mandrel 12 in such a manner that the lower side of the belt 49 forms a single loop 51 around the paper tape or tapes A.

In operation, when the motor 16 is switched on, the driving power of the motor 16 is first transmitted to the large spur wheel 19 and then to each drum through the corresponding small spur wheel. Then the belts 48 and 49 are driven by the drums.

The paper tape or tapes A are fed to the surface of the mandrel 12 along the upper side of the belt 48, i.e., from the bottom right-hand corner in FIG. 4. Then the paper tape or tapes A are rolled in the loop 50, and rotatory power is imparted to the paper tape or tapes A while the paper tape or tapes A are moved leftwards in FIG. 4 in the axial direction of the mandrel 12.

The loop 51 contributes to tightly winding the paper tape or tapes A round the mandrel 12.

Because the angle formed by the belts 48 and 49 is adjustable over a wide range, the angle at which the paper tape or tapes A are wrapped spirally around the mandrel 12 can be changed correspondingly over a wide range. The angle which is formed by the longitudinal edges of the paper tape A with the axis of the mandrel 12 ranges from 35° to 80°. Consequently, the apparatus in accordance with the present invention is suited for the manufacture of various paper pipes.

When each belt is stretched between two drums in such a manner as shown in FIG. 4, the longitudinal edges of the paper tape A are caused to form a small angle with the axis of the mandrel 12.

Figure 5:
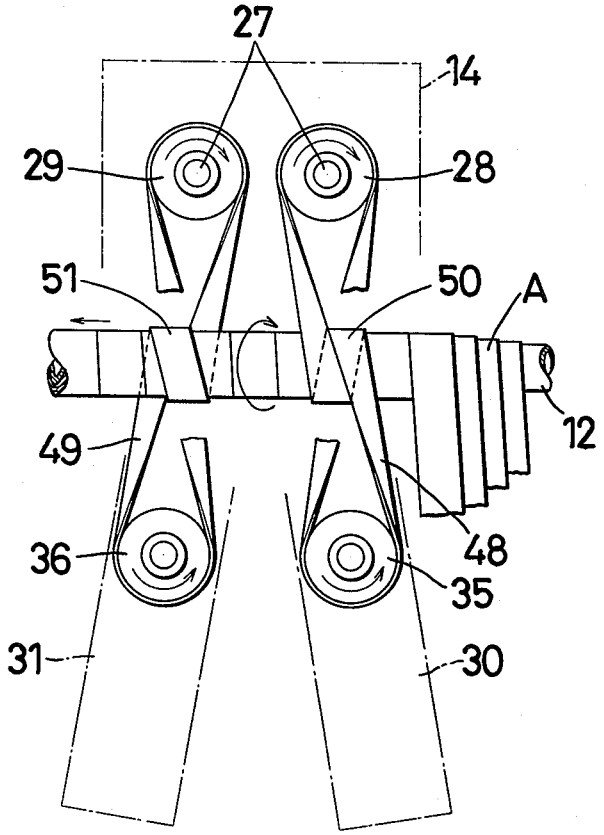
FIG. 5 is a plan view, illustrating another method of stretching each belt between two drums.
Figure 6:
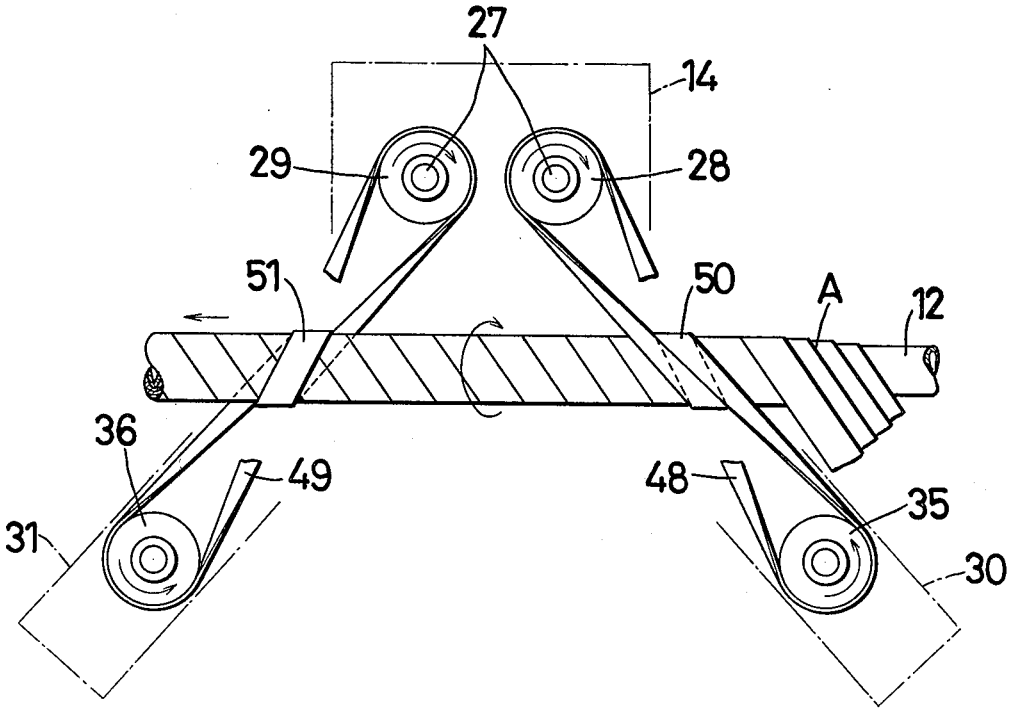
FIG. 6 is a plan view, illustrating still another method of stretching each belt between two drums.

In FIGS. 5 and 6, the belt 48 is run over the drums 28 and 35, and the belt 49 is run over the drums 29 and 36.

In FIG. 5, the drums 35 and 36 are placed in close proximity to each other so that only a small space is left between the loops 50 and 51. The small space between the loops 50 and 51 prevents the mandrel 12 from undergoing deflection, makes it possible for the paper tape or tapes A to be tightly wound round the mandrel 12, and makes the apparatus suitable for the manufacture of strong paper pipes.

In FIG. 6, a larger space is left between the drums 35 and 36 so that the paper tape A is at a smaller angle to the axis of the mandrel 12.

Fine adjustment of the angle formed by the belts 48 and 49 can be made by moving the drums 35 and 36 toward or away from the mandrel 12 by turning the handwheels 42.

For manufacturing a paper pipe having an especially large wall thickness, two apparatuses may be arranged in series along a single mandrel 12. In this case, at the loop 50 of the second apparatus, a paper tape or tapes A are fed to the surface of the paper pipe delivered from the loop 51 of the first apparatus. The speed of revolution of the output shaft 20 in the second apparatus should be lower than that in the first apparatus in inverse proportion to the increase in the outer diameter of the paper pipe measured at the loop 50 of the second apparatus as compared with the outer diameter of the paper pipe measured at the loop 50 of the first apparatus.

While there has been disclosed a preferred embodiment of the present invention, it is to be understood that it has been described by way of example only, various other modifications being obvious.

What I claim is:

1. An apparatus for manufacturing paper pipes comprising: a horizontal mandrel in a fixed position; a table provided under said mandrel and movable in the axial direction of said fixed mandrel; a gear case fixed to the under surface of said table; a main vertical shaft provided substantially in the center of said gear case, the upper end portion of said main vertical shaft projecting above said table; a large spur wheel rotatably mounted on said main vertical shaft in said gear case; a means on said table for driving said large spur wheel; four vertical countershafts disposed around said large spur wheel; four small spur wheels fixed to the lower ends of said four vertical countershafts and engaging with said large spur wheel, the upper ends of said four vertical countershafts projecting above said table; two first drums fixed to the projecting parts of two of said four vertical countershafts so as to be stationary on said table and spaced from one side of said mandrel; two bevel gears on the upper ends of the remaining two of said four vertical countershafts and close to said fixed mandrel; two supporting frames extending horizontally over said table, one end of each of said two supporting frames being rotatably supported on the projecting part of said main vertical shaft; two horizontal shafts on said two supporting frames, respectively, and extending in the longitudinal directions thereof; a bevel gear provided on the end of each of said two horizontal shafts toward said main vertical shaft and engaging corresponding ones of said two bevel gears on the upper ends of said two vertical countershafts close to said fixed mandrel, two sliders mounted on said two supporting frames, respectively, and slidable in the longitudinal directions of said supporting frames; means for adjusting the positions of said two sliders on said two supporting frames; two second drums rotatably mounted on said two sliders, respectively; means for transmitting the rotary motion of said two horizontal shafts to said two second drums, respectively, for rotating said two second drums in the opposite direction to the direction of rotation of said two first drums irrespective of where said two sliders are positioned on said two supporting frames; a means for adjusting the angle formed between said two supporting frames; a belt running over one of said two first drums and one of said two second drums; and another belt running over the other of said two first drums and the other of said two second drums, the side of each of said two belts advancing toward the first drum and the side of each of said two belts receding from the first drum being crossed in such a manner that the advancing side is placed above the receding side and said fixed mandrel being between the advancing and receding sides, the side of one of said two belts advancing toward the first drum winding around said mandrel in a single loop around said fixed mandrel, and the side of the other of said two belts receding from the first drum winding around said mandrel in a single loop around said fixed mandrel.

* * * * *